US006357075B1

(12) United States Patent
Kaizuka

(10) Patent No.: US 6,357,075 B1
(45) Date of Patent: Mar. 19, 2002

(54) HAIR BRUSH

(75) Inventor: Kazutoshi Kaizuka, Fukuoka (JP)

(73) Assignee: Create Co., Ltd., Fukuoka (JP)

( * ) Notice: Subject to any disclaimer, the term of this patent is extended or adjusted under 35 U.S.C. 154(b) by 0 days.

(21) Appl. No.: 09/400,166

(22) Filed: Sep. 21, 1999

(51) Int. Cl.[7] ..... A46B 15/00
(52) U.S. Cl. ..... 15/207.2; 428/372
(58) Field of Search ..... 15/207.2; 428/372

(56) References Cited

U.S. PATENT DOCUMENTS 3,613,143 A * 10/1971 Muhler et al. ..... 15/207.2 X
3,618,154 A * 11/1971 Muhler et al. ..... 15/207.2 X
4,500,939 A * 2/1985 Gueret ..... 15/207.2 X
4,610,925 A * 9/1986 Bond ..... 15/207.2 X
5,987,688 A * 11/1999 Roberts et al. ..... 15/207.2 X

* cited by examiner

*Primary Examiner*—Mark Spisich
(74) *Attorney, Agent, or Firm*—Squire, Sanders & Dempsey LLP; David B. Abel; David B. Koo

(57) ABSTRACT

A hairbrush contains bristles formulated with powder formed from the mixture of both extreme infrared radiation material and poly-element minerals, which are then mixed into a plastic material, and attached to a bristle base of the hairbrush.

3 Claims, 1 Drawing Sheet

HAIR BRUSH

BACKGROUND OF THE INVENTION

1. The Field of the Invention

The field of the invention relates to hairbrushes.

2. Background Information

Conventional hairbrushes have consisted of bristles made from plastic material such as nylon or polybutylene terephthalate (PBT) so as to have strength, as well as resistance to heat and abrasion. The conventional hairbrush is able to provide moderate stimulation to the scalp when brushing the hair. However, it is unable to promote the shiny appearance of hair, encourage hair growth, and provide scalp care by stimulating blood circulation in the scalp. Therefore, a need was perceived for a hairbrush which promotes hair growth, provides scalp care, and creates shiny hair by stimulating blood circulation in the scalp.

SUMMARY OF THE INVENTION

The present invention is directed to a hairbrush that promotes hair growth, provides scalp care, and creates shiny hair by stimulation of blood circulation in the scalp. A hairbrush having features of the present invention comprises a hairbrush configuration having a bristle base to which bristles made from a combination of extreme infrared radiation material powder and poly-element mineral powder mixed with a plastic material are attached. Further, carbon may be added into the bristles.

Accordingly, it is an object of the present invention to provide a hairbrush which promotes hair growth, provides scalp care, and creates shiny hair by stimulating blood circulation in the scalp. Other and further objects and advantages will appear hereinafter.

BRIEF DESCRIPTION OF THE DRAWING

It is to be understood that the accompanying drawing is provided for the purpose of illustration only, and is not intended as a definition of the limits of the invention. The drawing schematically illustrates a preferred embodiment of the present invention in which.

DETAILED DESCRIPTION OF THE PREFERRED EMBODIMENT

Figure 1:
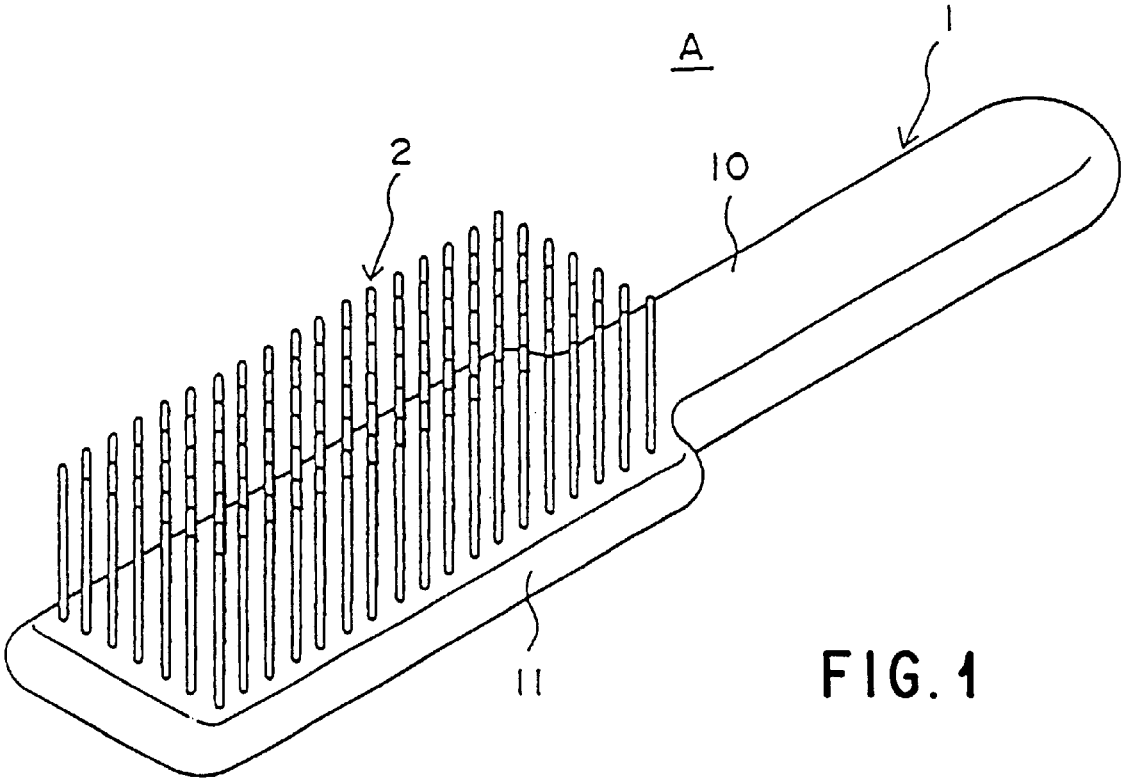
FIG. 1 is a perspective view of a hairbrush employing the preferred embodiment of the present invention.

Referring to the Figure, the hairbrush A comprises a hairbrush base 1 and bristles 2. The hairbrush base 1 comprises a handle 10, and bristle base 11, on which the bristles are attached or implanted. The hairbrush base 1 of the preferred embodiment is made of ABS resin. A number of the bristles 2 are implanted in the bristle base 11.

The bristles 2 are made of nylon, polybutylene terephthalate (PBT), or other suitable plastic material, containing mixed powders consisting of extreme infrared radiation material powder and poly-element minerals powder, as described below. The percentage of the volume of the powder to that of nylon is about 1 to 3%. If the percentage is over about 3%, the bristles 2 may bend easily and become unusable after a relatively short time. Extreme infrared radiation emits from the extreme infrared radiation material powder, and electromagnetic waves (feeble energy) with wave lengths of 4 to 14 $\mu$m are generated by the poly-element minerals powder.

The following compounds are made into powder and used as extreme infrared radiation materials: alumina ($Al_2O_3$), titania ($TiO_2$), ferrite ($Fe_2O_3$), chromium oxide ($Cr_2O_3$), silica ($SiO_2$), yttria ($Y_2O_3$), magnesia (MgO). These powders are used by being blended so that they will give off extreme infrared radiation with such wave lengths that are easily absorbed into the hair and scalp.

Additionally, poly-element minerals contain silicon-based minerals with various elements in good balance, such as perlite, pitchstone, and tourmaline. These minerals radiate electromagnetic waves (feeble energy) with a wave length of 4 to 14 $\mu$m. These electromagnetic waves electrically transform the surrounding of an atomic nucleus so that the atom and the material reach an excited state. In turn, a cutting and shortening of the polymerization of water clusters is caused, decreasing the volume of water and increasing the specific gravity. Furthermore, sufficient attachment of free water onto the external cell membranes of animals and plants occurs. As a result, the penetration of water, as well as that of $Ca^{2+}$, occur within the cells, which activate several functions of the cells. When the preferred embodiment of the present invention is applied to the hair and scalp, water within the hair will be mineralized, and protein in the hair and scalp will be activated.

Poly-element minerals, such as perlite, are milled into a powder the size of about 1 to 3 $\mu$m, using a ball mill. Preferably, the poly-element minerals powder is made and used by blending two or more such minerals with the proper blending ratio. The powder can be used as it is. Alternatively, it can also be used after it is mixed with water, and heated or pressurized, so that the clear liquid part of the water dries into a powder by vacuum-freeze drying or by spray drying methods well known in the art. The following chart shows the contents of perlite:

| | |
|---|---|
| Anhydrous Silicon ($SiO_2$) | 71.94% |
| Aluminum Oxide ($Al_2O_3$) | 14.94% |
| Iron Oxide ($Fe_2O_3$) | 2.54% |
| Magnesium Oxide (MgO) | 0.44% |
| Calcium Oxide (CaO) | 2.47% |
| Alkali Oxide ($K_2O + Na_2O$) | 6.87% |
| Manganese Oxide (MnO) | 0.03% |
| Anhydrous Phosphoric Acid ($P_2O_5$) | 0.14% |
| Reduction in mass when heated | 3.43% |
| Reduction in mass when dried (at 110° C.) | 0.07% |
| Others, Titanium | trace |

Furthermore, static electricity created during hair brushing can be prevented by adding carbon to the bristles 2.

The hairbrush A can be used independently or together with a hair dryer.

Thus, a hairbrush has been disclosed. While variations of the illustrated preferred embodiment have been shown and described, it would be apparent to those skilled in the art that many more modifications are possible without departing from the inventive concepts herein.

I claim:

1. A hairbrush comprising:

a bristle base; and a plurality of plastic bristles attached to the base, the plastic bristles containing a powder mixture of from about 1 to 3% of the volume of the plastic, the powder mixture comprising a powder blend including:

an extreme infrared material selected from the group consisting of alumina, titania, ferrite, chromium oxide, silica, yttria, and magnesia; and polyelement minerals selected from the group consisting of perlite, pitchstone and tourmaline.

2. The hairbrush of claim 1, in which the bristles contain carbon.

3. The hairbrush of claim 1, wherein said extreme infrared radiation material is a blended mixture of powders including alumina ($Al_2O_3$), titania ($TiO_2$), ferrite ($Fe_2O_3$), chromium oxide ($Cr_2O_3$), silica ($SiO_2$), yttria ($Y_2O_3$), and magnesia (MgO).

* * * * *